United States Patent [19]

Todd

[11] 4,004,547

[45] Jan. 25, 1977

[54] CHRISTIAN DOOR KNOCKER

[75] Inventor: James M. Todd, North Ridgeville, Ohio

[73] Assignee: Reigning Spirit of Truth, North Ridgeville, Ohio

[22] Filed: May 9, 1975

[21] Appl. No.: 576,097

[52] U.S. Cl. ..... 116/148; D8/177

[51] Int. Cl.[2] ..... G10K 1/10

[58] Field of Search ..... 116/148; D8/177

[56] References Cited

UNITED STATES PATENTS

| | | | |
|---|---|---|---|
| 3,734,054 | 5/1973 | Anderson | 116/148 |
| D86,968 | 5/1932 | Olson | D8/177 |
| D131,203 | 1/1942 | Beach | D8/177 |
| D211,566 | 7/1968 | Gragg | D8/177 |

*Primary Examiner*—Richard C. Queisser
*Assistant Examiner*—Daniel M. Yasich
*Attorney, Agent, or Firm*—Herbert D. Knudsen

[57] ABSTRACT

A Christian door knocker is described which has the form of a cross. The door knocker consists of a cross-shaped base and a knocking element disposed adjacent to the upright portion of the base for swinging movement with respect to the base.

1 Claim, 4 Drawing Figures

CHRISTIAN DOOR KNOCKER

BACKGROUND OF THE INVENTION

Numerous door knockers are known in the art. See for example U.S. Pat. No. 2,974,630 and U.S. Pat. No. 3,068,835. All door knockers perform substantially the same function of alerting the residents of a home that a guest is at the door.

The door knocker of the present invention goes beyond the utilitarian purpose of a door knocker and conveys to the guest the message that the family of this home is a Christian family. This is done by the symbol of the cross which is the door knocker of the invention in a position of repose.

SUMMARY OF THE INVENTION

The present invention is a door knocker comprising (a) a base for mounting on a door said base consisting of a transverse piece and an upright piece, said upright piece having a back face abutting the door, a front face and a top; and (b) a knocker element having a knocking surface and an outer surface, said knocking element being disposed adjacent to the front face of the upright piece and having one end connected to the top half of the upright piece for swinging movement of the knocker element toward and away from the upright piece of the base, the knocker element being adapted to strike the front face of the upright piece with the knocking surface. The door knocker of the invention is most conveniently understood by reference to the drawing.

DESCRIPTION OF THE DRAWING

Referring to FIG. 1 it is seen that FIG. 1 appears to be a solid cross consisting of an upright piece 10 which is the knocking element and a transverse piece 12 which forms a portion of the base. The only clue that the door knocker of the invention is distinguished from a regular solid cross is at the sides of the upright piece at the junction of the transverse piece. With careful craftsmanship this distinguishing feature can almost be eliminated.

Referring to FIG. 2 it is seen that the knocking element 10 is attached to the base 12 for swinging movement about hinge pin 14 along the paths shown by the arrows. It is also seen that the outer surface of the knocking element 10 is substantially the same height away from the door as the transverse piece of the base 12. The base of the door knocker consisting of the entire transverse piece and the rear portion of the upright piece is conveniently attached to the door by means of mounting screws which are preferably inserted into the door through the upright piece of the base.

FIG. 3 shows that the base 12 consists of both the transverse and rear portion of the upright piece. The knocking element is disposed along the front face of the upright piece of the base.

DETAILED DESCRIPTION OF THE INVENTION

Figure 3:
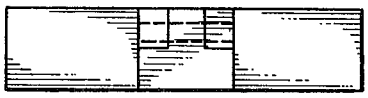
FIG. 3 shows a top view of the door knocker.
Figure 1:
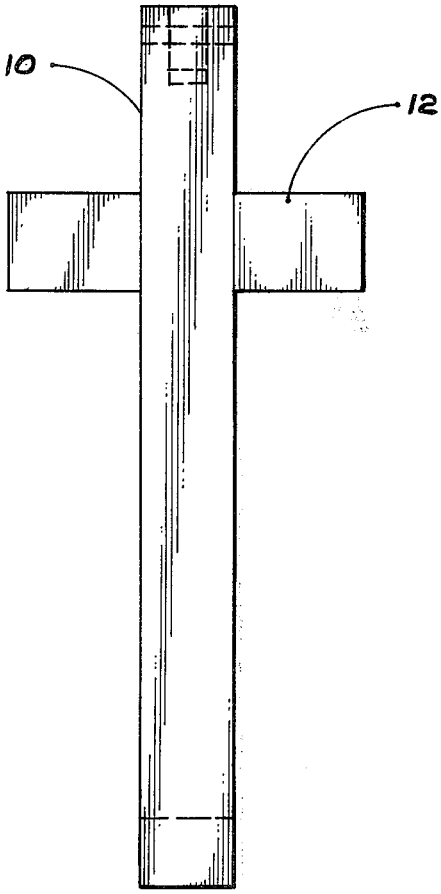
FIG. 1 shows a front view of the door knocker.
Figure 2:
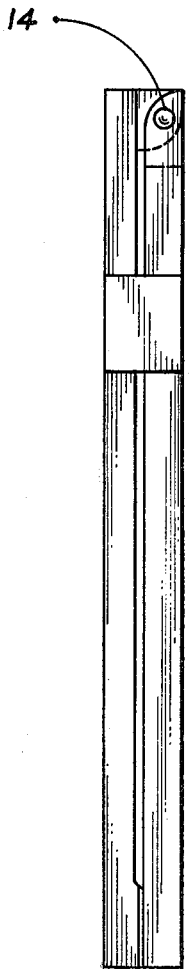
FIG. 2 shows a side view of the door knocker attached to a door.
Figure 4:
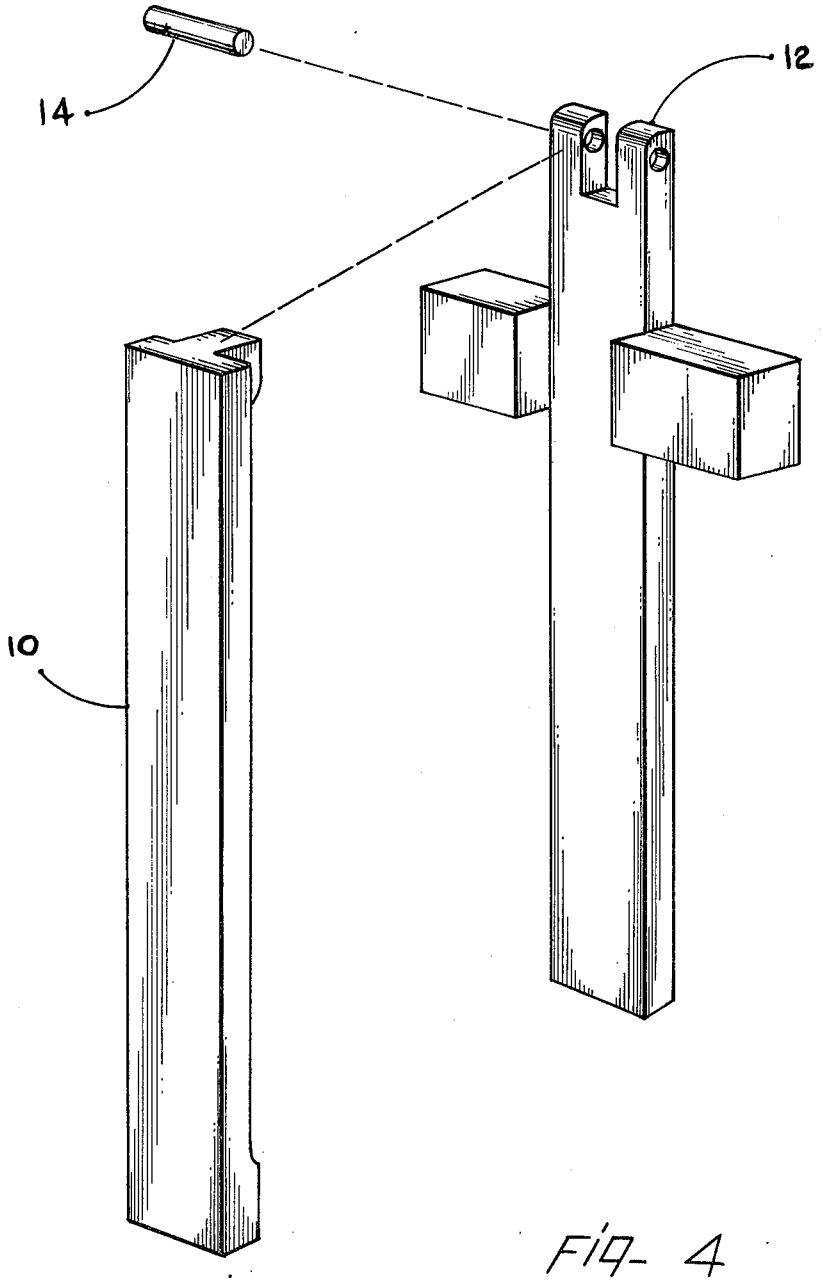
FIG. 4 shows an exploded view of the door knocker.

In the broad concept of the invention the invention is a door knocker in the form of a cross where the upright piece of the cross serves also as the knocking element. The knocking element strikes the base attached to the door thereby giving a clearly audible signal to the residents of that home that someone is at the door.

The base of the door knocker is normally of itself a cross. The transverse portion of the base is usually thicker than the rest of the base except at its intersection with the upright piece where it is thinner.

The knocker element can readily be a straight piece of metal that can come into contact with the base by a swinging motion. Preferably, however, the knocker element has a knocking surface which is only a portion of the knocker element adjacent to the front face of the upright piece. The knocker element usually extends down the entire length of the upright piece of the base.

As noted in the broad description of the invention the knocker element is connected to the top half of the upright piece for a swinging movement of the knocker element toward and away from the upright piece of the base. This connection can be made by a number of known techniques. A pin through a portion of the knocker element parallel to transverse piece is most suited to permit the desired movement of the knocker element.

The striking surface of the knocker element may vary widely. The striking surface may be the entire length of the knocker element or only a portion of the length. For example, the knocker element may extend beyond the bottom of the upright piece of the base and strike a striking plate which would be considered to be a part of the base.

The main purpose of this door knocker, however, is to designate the home as a Christian home —the cross in and of itself sends this message. In variations of this door knocker a holder could be provided with either a fixed or changeable message, such as a Scripture verse. This and many other possible variations of the door knocker design are covered by the present invention.

I claim:

1. A door knocker comprising: (a) an elongated base for mounting on the outer surface of a door said base consisting of a transverse piece having an outer surface and a recessed portion and an upright piece having a back face abutting the outer surface of the door, a front face and a top; and (b) a knocker element having a knocking surface and an outer surface, said knocker element being disposed longitudinally coextensive to the front face of the upright piece and having one end connected to the top half of the upright piece for swinging movement of the knocker element toward and away from the upright piece of the base and within the recessed portion of the transverse piece to strike the front face of the upright piece with the knocking surface, wherein the outer surface of the transverse piece and the outer surface of the knocking element are in the same plane.

* * * * *